United States Patent [19]

Rankin

[11] 3,990,120

[45] Nov. 9, 1976

[54] SAFETY RING FOR BATHERS

[76] Inventor: William A. Rankin, 422 Davis, The Georgian, Evanston, Ill. 60201

[22] Filed: Sept. 10, 1975

[21] Appl. No.: 611,922

[52] U.S. Cl. ..... 4/185 R; 4/185 AB; 4/185 H

[51] Int. Cl.[2] ..... A47K 3/12

[58] Field of Search ..... 4/185 R, 185 B, 185 H, 4/185 HB, 185 S, 254

[56] References Cited

UNITED STATES PATENTS

| | | | |
|---|---|---|---|
| 1,428,039 | 9/1922 | Kratz | 4/185 B |
| 2,817,095 | 12/1957 | Jeffries | 4/185 B |
| 3,474,471 | 10/1969 | Matibag | 4/254 |

FOREIGN PATENTS OR APPLICATIONS

| | | | |
|---|---|---|---|
| 2,011,461 | 10/1970 | Germany | 4/185 R |

*Primary Examiner*—Charles E. Phillips
*Attorney, Agent, or Firm*—Lockwood, Dewey, Zickert & Alex

[57] ABSTRACT

A body-encircling safety ring is supported from at least one side wall of a shower bath installation so as to allow a person showering free use of both hands while preventing a fall in any direction. The preferred support for the safety ring is a horizontal rod anchored at the desired level to a side wall of the shower installation. The preferred form of safety ring comprises two mating semi-circular halves with each half having an ear formation on one end allowing it to be supported in cantilever fashion in various positions along the horizontal rod. Spring-actuated locking means are mounted in the ear formations for cooperating with recesses spaced along a groove extending lengthwise of the rod so as to allow the semi-circular halves to be positioned as desired on the rod. Short transverse escape grooves will be provided adjacent both ends of the rod communicating at right angles with the longitudinal groove so as to allow one of the semi-circular halves to be tilted upwardly and thereby to permit a bather to step into or out of the opened safety ring. In use both ring halves will be closed and locked horizontally around the body of the bather.

6 Claims, 6 Drawing Figures

SAFETY RING FOR BATHERS

This invention relates generally to safety ring support means for preventing falls by persons while they are using both hands in taking shower baths. The general object of the invention is to provide a practical and economical safety means which will permit persons taking shower baths safe free use of both hands.

It is well known that persons taking shower baths run some risk of falling due to slipping or loss of balance. This risk increases as persons become infirm or less agile for one reason or another. Many older persons who have long practiced taking shower baths in preference to tub baths would like to continue the practice without the risk of falling in doing so. At the present time many, if not most, shower bath installations do not include any safety means for preventing falls and those that do usually require the bather to use one of his hands to grasp a hand-hold fixture of some type. However, it is awkward at best to take a shower bath using only one hand.

As indicated above, the general object of the present invention is the provision of safety means in the form of a body-encircling ring which is adequately supported in a shower bath installation in such manner as to prevent falls and thereby leave a bather with two hands free.

A specific object of the invention is the provision of body-encircling safety ring means for shower bath installations which may be readily installed in either new or existing installations.

A further object of the invention is the provision of a body-encircling safety ring installation of the type described which the bather can conveniently manipulate so as to place in the desired position or location with respect to the shower head.

Still another object of the invention is the provision of a body-encircling safety ring for shower bath installations which the bather can readily manipulate in respect to conveniently entering and exiting but which will not become accidentally disengaged or opened in the course of taking a shower bath.

Certain other objects of the invention will become apparent on consideration of the following detailed description of the invention wherein two embodiments of the invention are set forth.

For a more complete understanding of the nature and scope of the invention reference may now be had to the following detailed description of two preferred embodiments in conjunction with the accompanying drawings wherein.

Figure 1:
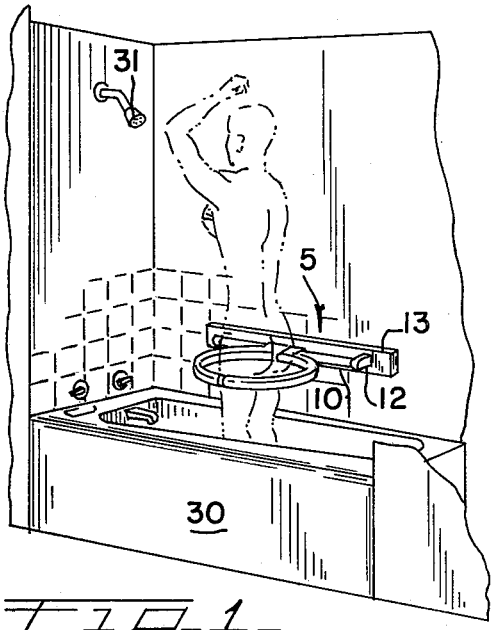
FIG. 1 is a fragmentary perspective view of one of the preferred embodiments installed on one vertical side wall of a combination shower and tub bath installation.

Referring to FIGS. 1–5, the body-encircling safety ring means is indicated generally at 5 and includes a body-encircling safety ring indicated at 6 and formed of two semi-circular halves 7 and 8. The safety ring 6 is mounted in cantilever fashion on a horizontal support rod or bar 10 supported at opposite ends by brackets 11 and 12 which are in turn mounted on a wall-engaging support bar 13. It will be understood that in certain installations the bar 13 may be dispensed with and the end support brackets 11 and 12 anchored directly on the vertical side wall of the shower bath installation.

In installing the body-encircling safety ring means 5 care should be taken to have the supports for the rod 10 adequately and permanently anchored to solid structural members such as the studs 14—14. While the vertical position of the body encircling ring 6 is to some extent a matter of preference, in general it should be located so as to encircle the buttocks region of the average person.

Figure 3:
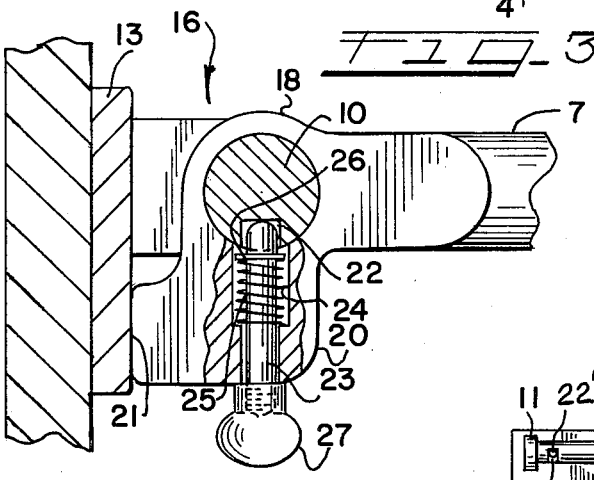
FIG. 3 is an enlarged detail sectional view taken on line 3—3 of FIG. 2.
Figure 5:
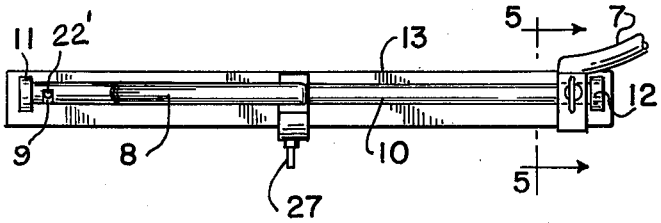
FIG. 5 is a detail view taken on line 5—5 of FIG. 4.
Figure 5:
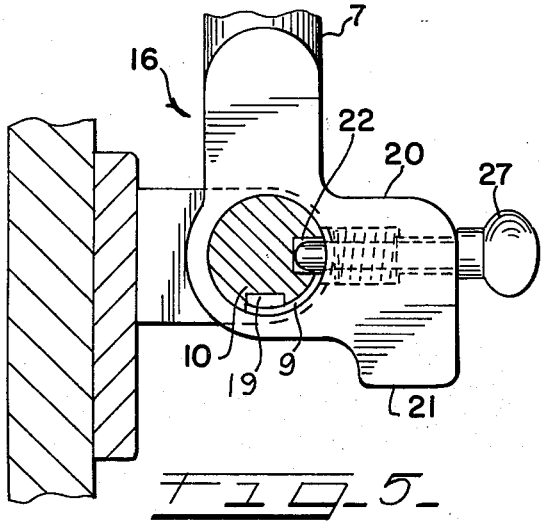

Each of the semi-circular safety ring halves 7 and 8 may be formed of solid or tubular rod stock having adequate strength. At their outer free ends the halves 7 and 8 come close to touching as indicated at 15 and at their inner or opposite ends adjacent the side wall they are provided with integrally formed ear formations 16 and 17 which may be identical. As shown in FIGS. 3 and 5, each of the ear formations 16 and 17 includes a horizontally apertured upper portion 18 and a lower foot portion 20. The opening or aperture within the apertured portion 18 is sized so as to have a sliding fit over the support rod 10. Each foot portion 20 extends downwardly at approximately 90° with respect to the semi-circular ring 6 when the latter is in its cantilevered horizontal position with each foot having a vertical wall-engaging toe or face 21. It will be seen from FIG. 3 that with this arrangement each semi-circular ring 7 and 8 is firmly supported in a cantilever fashion from the support rod 10. It will be seen also that with this arrangement that the semi-circular halves 7 and 8 comprising the safety ring 6 cannot at any time be tilted downwardly appreciably beyond or below the horizontal position.

Figure 4:
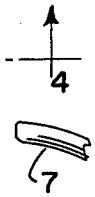
FIG. 4 is an elevational view taken on line 4—4 of FIG. 2 and showing one semi-circular half of a safety ring means in its vertical, raised or open position.

In order to maintain the two semi-circular halves 7 and 8 positioned next to each other in closed body-encircling relationship about a bather and prevent the same from tilting upwardly a suitable detent means is provided for each half. This takes the form of a plurality of uniformly spaced pockets or recesses 22—22 in a groove 19 (FIG. 5) extending lengthwise along the underside of the support rod 10 and a spring-loaded or biased locking pin 23 in a bore provided therefor in each of the ear formations 16 and 17. Each of the bores is provided with an enlarged inner section 24 so as to accommodate a spring 25 maintained under compression between the bottom shoulder of the enlarged chamber 24 and a washer 26 secured on the upper end of the locking pin 23. A manipulating knob 27 is screwed onto the threaded projecting end of each locking pin from engagement in any particular pocket or recess 22 along groove 19 thereby allowing the associated semi-circular halves 7 and 9 to be slid laterally along the support rod 10. In FIGS. 4 and 5 the semi-circular ring half 7 is shown in its raised position at the right hand end of the bar or support rod 10 while the semi-circular half 8 remains horizontal in the mid-portion of the rod. The upward tilting of each ring half 7 and/or 8 is permitted by providing a transverse escape groove or means 9—9 at each end of the longitudinal groove 19. Each escape groove 9 extends 90° to the longitudinal groove 19 and its dead end is provided with a recess 22′.

Figure 2:
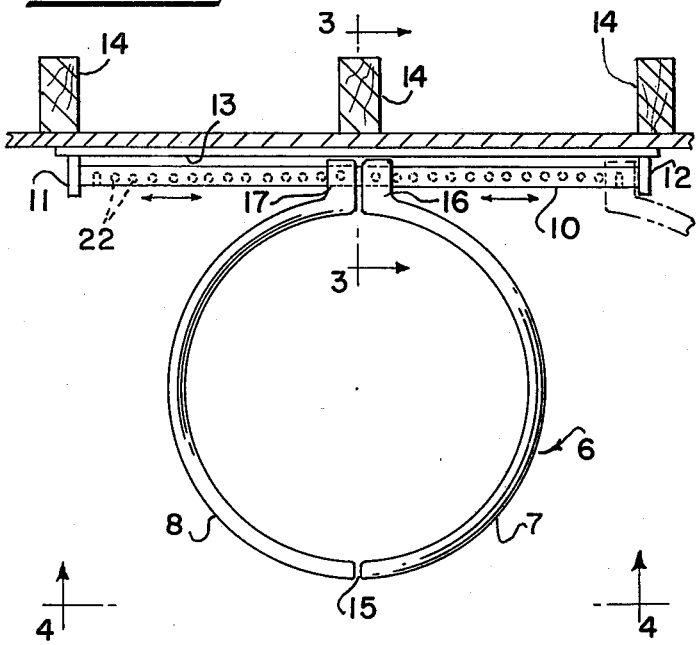
FIG. 2 is a top plan view of the body-encircling safety ring means shown in FIG. 1.

In use it will be appreciated that the normal practice will be for a bather on completing a shower to leave both halves 7 and 8 of the safety ring 6 tilted into their upper out-of-the-way position against the side wall of the installation at opposite ends of the rod 10 thereby permitting other persons free use of the bath tub 30. A person desiring to take a shower will lower one of the semi-circular halves 7 or 8 to the horizontal position, then step into the tub and positions the body against the inner circumference of the already lowered semi-circular halves 7 or 8. He then lowers the other half. When in the desired position in relation to the shower head, both halves are moved together about the body as shown in FIG. 2 or as close thereto as desired. The bather's body now is provided with adequate support from all sides and he or she is free to take a shower bath while using both hands.

When the bather finishes his shower, he then manipulates the knobs 27 on the semi-circular halves 7 or 8 and moves them to their fully separated positions. He then raises one half to its vertical position so that he can readily leave the tub and step out onto the floor. Finally, as mentioned above, the bather will ordinarily raise the second half so that both of the semi-circular halves 7 or 8 will be lifted upwardly against the wall and out of the way.

If desired, the free outer ends of the ring halves 7 and 8 may be releaseably interconnected in various ways so that weight or downward force applied to one will be shared by both. One form of mechanical interconnecting is to provide a female socket in the outer end of one of the halves 7 or 8 and a mating pin on the end of the other half. The pin and socket will interlock when the ring halves 7 and 8 are closed together. Other interconnecting arrangements will be apparent. For example, instead of using a pin and socket connection other interlocking formations may be used.

Figure 6:
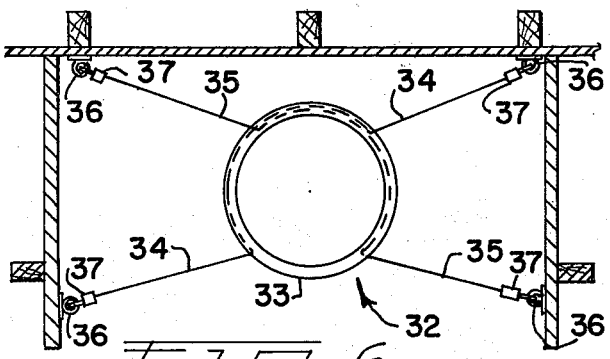
FIG. 6 is a plan view, partly in horizontal section, showing a second embodiment of the invention.

Referring to FIG. 6, a second form of body-encircling safety ring means is indicated generally at 32 comprising a body-encircling safety ring 33 supported by a pair of cables 34 and 35 from three vertical side walls of a shower stall installation. The supports for the cables include four screw eyes 36—36 suitably positioned such as where they can be anchored into wall studs as shown. The safety ring 33 is preferably hollow and provided with four apertures so as to allow the cables 34 and 35 to be suitably threaded therethrough in the manner indicated. The cables are provided on opposite ends with suitable safety snaps 37—37 by which they can be readily attached or detached from the screw eyes 36—36.

It will be apparent that the safety ring installation 32 in FIG. 6 can be used in several different ways. For example, the person to take a shower bath may detach all four snaps 37—37 so that the ring 33 is free to be placed around the body. The person then steps into the shower stall and proceeds to attach each of the snaps 37 to the appropriate hook eye 36. It will be seen that with this arrangement the safety ring 33 is provided with support from all four quadrants so that no matter which way the bather may lean against the inside of the ring 33, he or she will receive adequate support against falling.

It will be apparent to those skilled in the art that certain changes or modifications of a detailed design nature may be made in the foregoing embodiments without departing from the spirit and scope of the present invention as defined in the appended claims.

I claim:

1. Safety ring body support means for use by persons in a shower bath installation including at least one vertical side wall said means comprising, in combination, a safety ring support rod, bracket means horizontally anchoring said support rod on said side wall in spaced relation therewith, and a body-encircling ring formed in two semi-circular mating sections with each section having an ear formation integrally formed on one end, each of said ear formations having a transverse rod-receiving aperture therein through which said support rod extends and a foot portion with a toe for engaging said side wall below said support rod so as to support the associated mating section in a cantilever fashion while permitting it to be swung upwardly.

2. The safety ring body support means called for in claim 1 wherein said horizontal safety ring support rod has a plurality of recesses spaced along the under side thereof and each of said ear formations houses a retractable spring-biased vertical pin with the upper end thereof selectively engageable in said recesses for releasably locking the associated mating section in selected position on said rod.

3. The safety ring body support means called for in claim 2 wherein said rod has an elongated groove in the underside and said recesses are located in said groove.

4. The safety ring body support means of claim 3 wherein there is a transverse escape groove extending upwardly at approximately 90° to said elongated groove adjacent at least one end thereof so that at least one ring section can be tilted upwardly to an upright position.

5. The safety ring body support means of claim 4 wherein a recess for said pin is located at the dead end of said transverse escape groove.

6. A safety ring body support means for use by persons in a shower bath installation which has at least one vertical side wall, said safety ring body support means comprising in combination a body encircling ring formed in two sections, a safety ring support rod, bracket means anchoring said support rod in a horizontal position to said side wall at each end of said rod, each ring section being capable of movement along said rod, and transverse escape means at each end of said rod to allow pivoting of said sections to a vertical position.

* * * * *